US009371809B2

(12) United States Patent
Kato

(10) Patent No.: US 9,371,809 B2
(45) Date of Patent: Jun. 21, 2016

(54) RECOIL STARTER

(71) Applicant: Hiroki Kato, Tokyo (JP)

(72) Inventor: Hiroki Kato, Tokyo (JP)

(73) Assignee: STARTING INDUSTRIAL CO., LTD., Tokyo (JP)

( * ) Notice: Subject to any disclaimer, the term of this patent is extended or adjusted under 35 U.S.C. 154(b) by 188 days.

(21) Appl. No.: 14/144,815

(22) Filed: Dec. 31, 2013

(65) Prior Publication Data

US 2014/0190440 A1 Jul. 10, 2014

(30) Foreign Application Priority Data

Jan. 7, 2013 (JP) ..... 2013-000316

(51) Int. Cl.
*F02N 3/02* (2006.01)
*F02N 15/02* (2006.01)

(52) U.S. Cl.
CPC ..... *F02N 3/02* (2013.01); *F02N 15/027* (2013.01)

(58) Field of Classification Search
CPC ..... F02N 3/02; F02N 15/027
See application file for complete search history.

(56) References Cited

U.S. PATENT DOCUMENTS 2,848,987 A * 8/1958 Morden ..... F02N 3/02 123/185.3
3,728,914 A * 4/1973 Guangorena ..... B66D 1/7431 254/354
5,676,103 A * 10/1997 Tsunoda ..... F02N 15/006 123/185.3
2003/0213455 A1* 11/2003 Tohyama ..... F16F 15/1216 123/185.3
2004/0016311 A1* 1/2004 Hashiba ..... A01D 34/6818 74/8
2004/0079313 A1* 4/2004 Tsunoda ..... F02N 3/02 123/185.3
2004/0123827 A1* 7/2004 Tsunoda ..... F02N 3/02 123/185.3
2005/0056248 A1* 3/2005 Nieda ..... F02N 3/02 123/185.3
2005/0252477 A1* 11/2005 Schriever ..... F02N 3/02 123/185.14
2013/0247860 A1* 9/2013 Nishimura ..... F02N 15/027 123/185.3
2014/0190440 A1* 7/2014 Kato ..... F02N 3/02 123/185.3

FOREIGN PATENT DOCUMENTS

EP 2202405 A2 * 6/2010 ..... F02N 3/02
JP 9-242652 9/1997
JP 2004-124825 4/2004
KR 20040030357 A * 4/2004 ..... F02N 3/02

OTHER PUBLICATIONS

Extended European Search Report dated Apr. 10, 2014 issued in European Patent Application No. 13199539.1, 7 pp.

* cited by examiner

*Primary Examiner* — Marguerite McMahon
*Assistant Examiner* — Tea Holbrook
(74) *Attorney, Agent, or Firm* — Nixon & Vanderhye P.C.

(57) ABSTRACT

A recoil starter exemplified in the embodiment includes: a starter case; a rope reel; a recoil rope; a ratchet; and a drive pulley. When the rope reel is rotated by pulling the recoil rope, the ratchet pivots to engage an engaged unit of the drive pulley to thereby transmit a torque of the rope reel to an engine. The rope reel has: a ratchet receiving unit; and a reinforcing unit. The ratchet receiving unit is arranged to receive a front end portion of the ratchet when it is engaged with the engaged unit of the drive pulley. And, the reinforcing unit extends in a circumferential direction of the rope reel with respect to the ratchet receiving unit as its leg portion.

5 Claims, 4 Drawing Sheets

RECOIL STARTER

CROSS-REFERENCE TO RELATED APPLICATION(S)

This application claims priority/priorities from Japanese Patent Application No. 2013-000316 filed on Jan. 7, 2013, the entire contents of which are herein incorporated by reference.

FIELD

The present invention relates to a recoil starter in which a torque of a rope reel generated by pulling a recoil rope is transmitted to a drive pulley connected to a crankshaft of an engine through a ratchet mechanism to thereby start the engine.

BACKGROUND

A recoil starter may have a ratchet mechanism configured to cause a rope reel to engage or disengage with a drive pulley, so that the rotation of the rope reel is transmitted to an engine upon pulling of the recoil rope but the rotation of the engine is not transmitted to the rope reel after the engine starts.

As such ratchet mechanism, a ratchet may be provided on the rope reel. In this case, since the rope reel is required to receive the load applied to the ratchet, the rope reel needs to have a sufficient rigidity. If the rigidity of the rope reel is not sufficient, the rope reel may be deformed, and thus, the ratchet may come off.

In view of above, for example, JP-2004-124825-A discloses the technique to provide a recoil starter with a sufficient strength without increasing the thickness of a rope reel. JP-2004-124825-A proposes to form a supporting hole for pivotably supporting a ratchet member as a completely circular hole so that the strength of the periphery of the supporting hole can be sufficiently secured, and to provide a receiving member for receiving an end portion of an arm unit of the ratchet member.

On the other hand, a high rigid material such as a glass reinforcing material (e.g., a glass-fiber reinforced resin) has been conventionally used in order to secure the strength of the rope reel. However, such high rigid material is generally expensive, thereby increasing the manufacturing cost. In other words, if it is possible to realize the sufficient strength in terms of a structure by even using a low rigid material, a material cost can be reduced.

SUMMARY

One object of the present invention is to provide a recoil starter capable of preventing deformation of a rope reel even when the rope reel is made from a low rigid material to thereby reduce the manufacturing cost.

The present invention provides following Aspects 1 to 4.

Aspect 1 provides a recoil starter including:

a starter case (11);

a rope reel (12) attached rotatable to the starter case (11);

a recoil rope (13) wound around the rope reel (12);

a ratchet (14) pivotably attached to the rope reel (12); and a drive pulley (15) connected to an engine, the drive pulley (15) having an engaged unit (15*a*) engageable with the ratchet (14), wherein, when the rope reel is rotated by pulling the recoil rope (13), the ratchet (14) pivots to engage the engaged unit (15*a*) of the drive pulley (15) to thereby transmit a torque of the rope reel (12) to an engine, and wherein the rope reel (12) has:

a ratchet receiving unit (12*c*) arranged to receive a front end portion (14*b*) of the ratchet (14) when it is engaged with the engaged unit (15*a*) of the drive pulley (15); and a reinforcing unit (12*d*) that extends in a circumferential direction of the rope reel (12) with respect to the ratchet receiving unit as its leg portion.

Aspect 2 provides the recoil starter of Aspect 1, wherein the reinforcing unit (12*d*) is formed to cover the front end portion (14*b*) of the ratchet (14) when it contacts the ratchet receiving unit (12*c*) and to thereby suppress floating of the front end portion (14*b*) of the ratchet (14).

Aspect 2 provides the recoil starter of Aspect 1, wherein two ratchet receiving units (12*c*, 12*c*) are provided as the ratchet receiving unit (12*c*) in a line symmetry manner with respect to the reinforcing unit (12*d*).

Aspect 4 provides the recoil starter of Aspect 3, further including:

a control member (18) attached to the starter case (11) concentrically with the rope reel (12), wherein the ratchet (14) has a projection (14*c*), and the control member (18) has an engaging groove (18*a*) which receives the projection (14*c*) and which extends to guide a pivoting movement of the ratchet (14) to project radial outward, and wherein two engaging grooves (18*a*) are provided as the engaging groove (18*a*) in a line symmetry manner.

According to Aspect 1, the rope reel includes the ratchet receiving unit arranged to receive the front end portion of the ratchet engaging the engaged unit of the drive pulley, and the reinforcing unit that extends in the circumferential direction with respect to the ratchet receiving unit as its leg portion. Thus, the reinforcing unit reinforces the ratchet receiving unit on which a load is applied, thereby preventing deformation of the rope reel. Since the reinforcing unit is formed continuously with the ratchet receiving unit, the rope reel can be structurally simplified and can be reduced in weight.

According to Aspect 2, since the reinforcing unit is formed to cover the front end portion of the ratchet projecting outward, floating of the front end portion can be suppressed, and the ratchet can be prevented from coming off the ratchet receiving unit even when the rope reel is deformed. Since this effect is achieved by the reinforcing unit, it is unnecessary to provide another member arranged to suppress the floating, thereby simplifying the structure.

According to Aspect 3, since the ratchet receiving units are provided in a line symmetry manner with respect to the reinforcing unit, the present invention can be applied to an engine regardless of its rotation direction by using either one of the ratchet receiving units. Thus, it is unnecessary to manufacture two kinds of rope reels for both rotation directions of engines, thereby reducing the manufacturing cost.

DETAILED DESCRIPTION

An embodiment will be described with reference to drawings.

Figure 1:
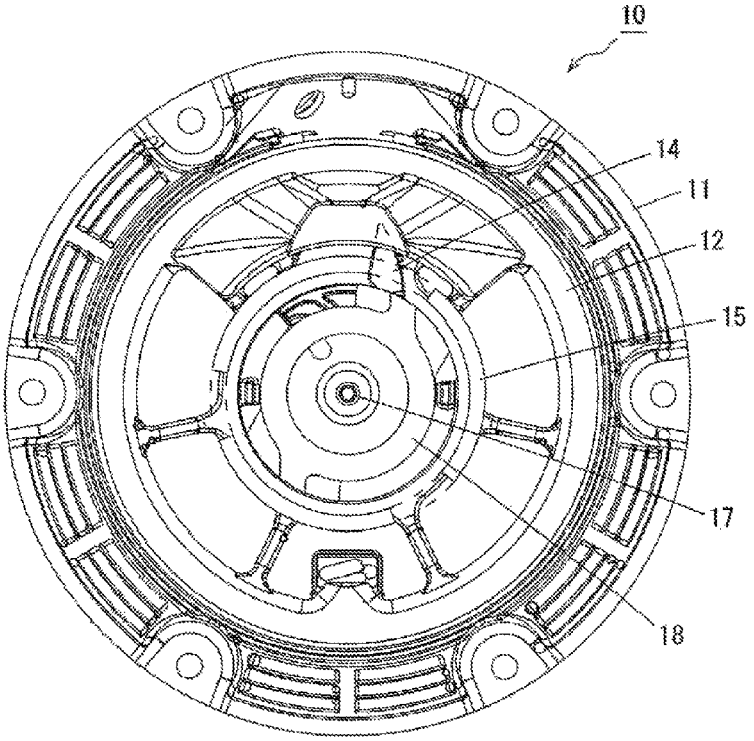
FIG. 1 is a front view of a recoil starter.
Figure 2:
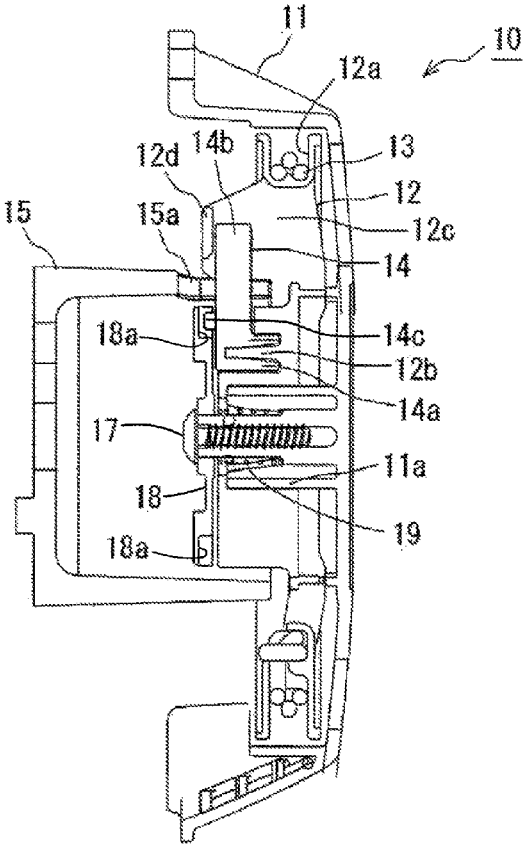
FIG. 2 is a cross-sectional view of the recoil starter.

A recoil starter 10 according to the present embodiment includes a starter case 11, a rope reel 12, a recoil rope 13, a ratchet 14 and a drive pulley, as shown in FIGS. 1 and 2. The starter case 11 is formed to accommodate main components of the recoil starter 10 and to cover a rotary unit of an engine. The rope reel 12 is rotatably attached to the starter case 11. The recoil rope 13 is wound around the rope reel 12. The ratchet 14 is pivotably attached to the rope reel 12. The drive pulley 15 includes engagement portion 15*a* with which the ratchet 14 is engaged.

The starter case 11 has a reel supporting unit 11*a* that projects toward a crankshaft of the engine, and the rope reel 12 is rotatably attached to the reel supporting unit 11*a*.

The rope reel 12 has a rope holding groove 12*a* on an outer periphery thereof so as to be opened radial outward. And, the recoil rope 13 is wound around the rope holding groove 12*a*, such that one end thereof is fixed to the rope reel 12, and the other end thereof is drawn out of the starter case 11 through an opening (not illustrated) formed therein. Thus, the rope reel 12 rotates upon pulling of the recoil rope 13.

A recoil spiral spring (not illustrated) is disposed between the rope reel 12 and the starter case 11. The recoil spiral spring urges the rope reel 12 in the reverse direction to rewind the recoil rope 13. While one end of the recoil spiral spring is fixed to the rope reel 12, the other end of the recoil spiral spring is fixed to the starter case 11, such that torque is stored in the recoil spiral spring when the recoil rope 13 is pulled to rotate the rope reel 12. Thus, when the recoil rope 13 is released, the rope reel 12 is rotated in the reverse direction by the torque stored in the recoil spiral spring, and the drawn-out recoil rope 13 is rewound into the rope reel 12.

Figure 3:
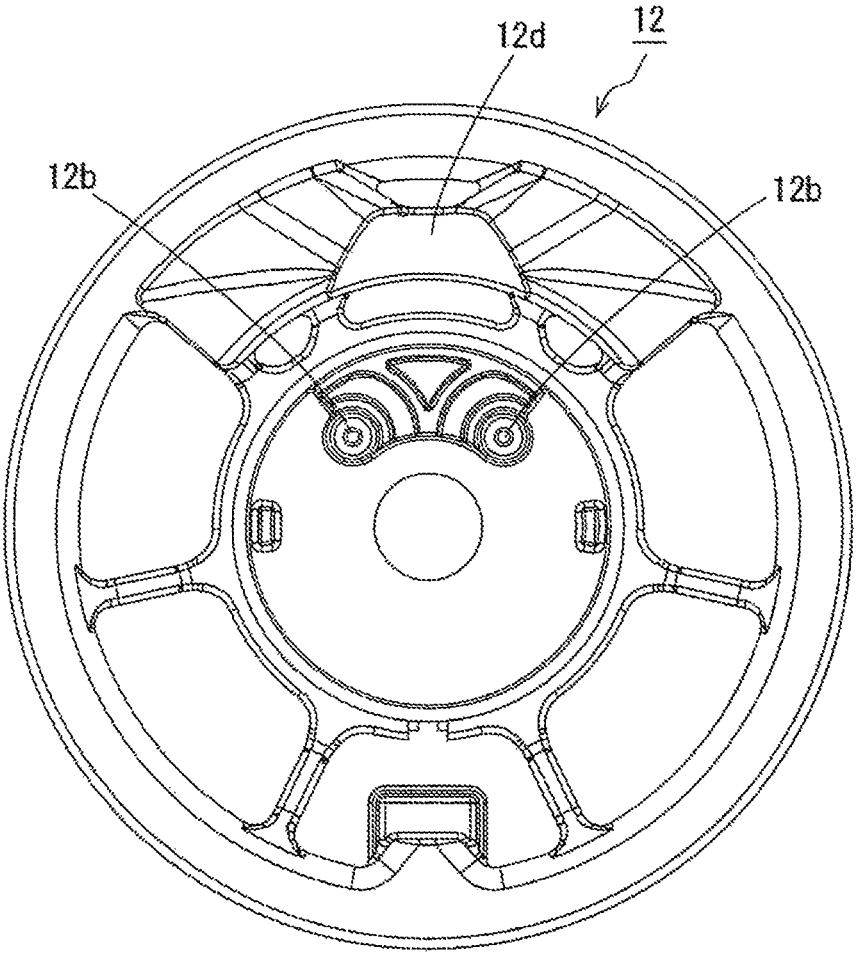
FIG. 3 is a front view of a rope reel.
Figure 4:
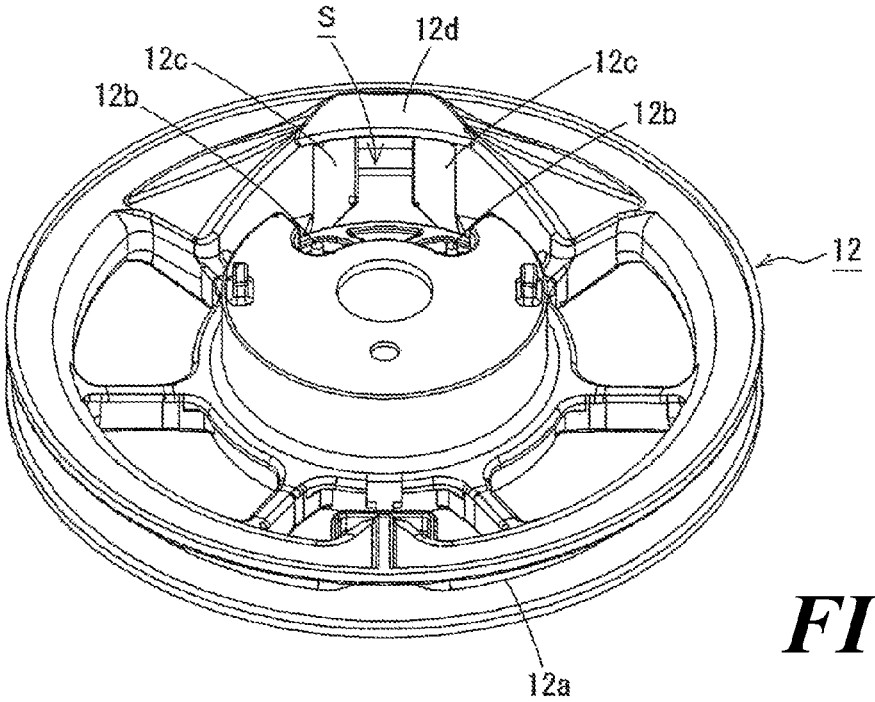
FIG. 4 is a perspective view of the rope reel.

The rope reel 12 further has two ratchet support shafts 12*b*, two ratchet receiving units 12*c* and a reinforcing unit 12*d*, as shown in FIGS. 3 and 4. The two ratchet support shafts 12*b* project at positions slightly offset from the rotation center, and each of the ratchet support shafts 12*b* is capable of pivotably supporting the ratchet 14. The two ratchet receiving units 12*c* facing with each other are positioned more radial outward than the two ratchet support shafts 12*b* so as to respectively correspond to the two ratchet support shafts 12*b*. The ratchet receiving units 12*c* function as the wall units which receive the ratchet 14 having been pivoted. The rope reel 12 is formed in symmetric manner in which the two ratchet support shafts 12*b* and the two ratchet receiving units 12*c* face with each other, respectively.

In addition, the reinforcing unit 12*d* is provided to bridge between the two facing ratchet receiving units 12*c*.

Figure 6:
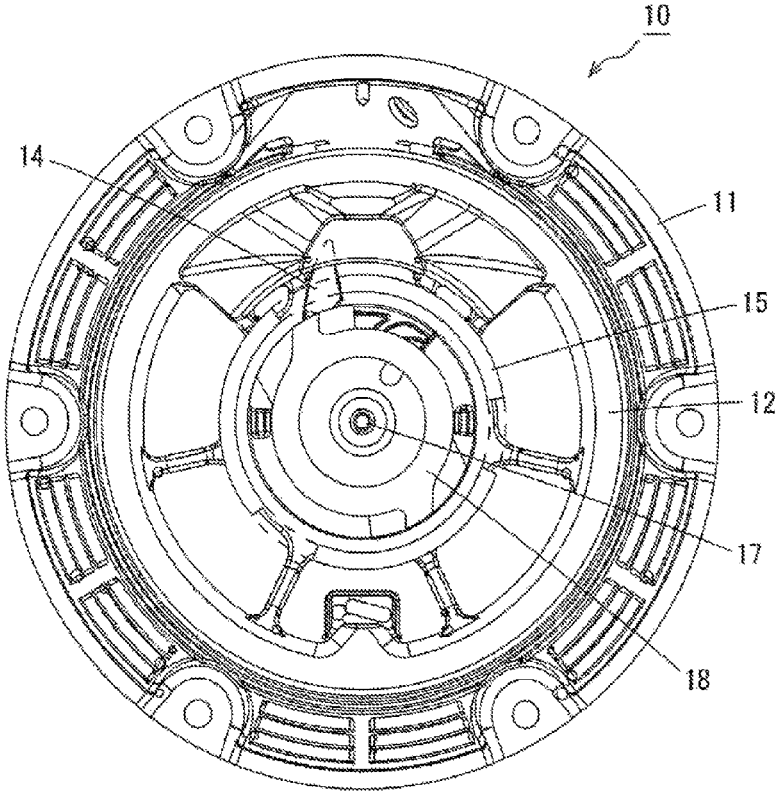
FIG. 6 is a front view of a recoil starter having another ratchet arrangement.

The ratchet 14 has a base portion 14*a*, a front end portion 14*b* and a projection 14*c*. The ratchet 14 is pivotably attached to the rope reel 12 such that the base portion 14*a* is pivotably fixed to the ratchet support shaft 12*b* of the rope reel 12, and that the front end portion 14*b* is projectable outward. The projection 14*c* is formed on a surface of the ratchet 14. The ratchet 14 is fixed to either of the two ratchet support shafts 12*b* of the rope reel 12. The ratchet support shaft 12*b* to which the ratchet 14 is fixed may be determined depending on the rotation direction of the engine. FIG. 1 exemplifies the case where the ratchet 14 is attached on the right-side ratchet support shaft 12*b* as the rotation direction of the engine is the counterclockwise direction in FIG. 1. The same recoil starter 10 can be applied for an engine which rotates in the reverse direction by attaching a ratchet, which has the mirror-reversed structure, to the other ratchet support shaft 12*b* as shown in FIG. 6.

The drive pulley 15 functions as a cup-shaped member attached which covers the ratchet support shafts 12*b* of the rope reel 12 and the ratchet 14 in a retracted position. The drive pulley 15 is attached to the crankshaft of the engine to receive the torque from the rope reel 12. For example, three engagement portions 15*a* are formed at regular intervals in the circumferential direction on a peripheral wall of the drive pulley 15 as shown in FIG. 1. Thus, the drive pulley 15 is engageable with the ratchet 14 as the front end portion 14*b* of the ratchet 14 projecting outward is inserted into the engagement portion 15*a* to be engaged with the peripheral edge of the opening.

A control member 18 is attached to an end face of the reel supporting unit 11*a* of the starter case 11 with a set screw 17 as shown in FIG. 2, and the rope reel 12 is prevented from coming out of the reel supporting unit 11*a* by the control member 18.

A friction spring 19 is disposed between the control member 18 and the reel supporting unit 11*a* so as to produce predetermined friction resistance between the control member 18 and the set screw 17. Thus, the friction resistance is imposed on the rotation of the control member 18.

Figure 7A:
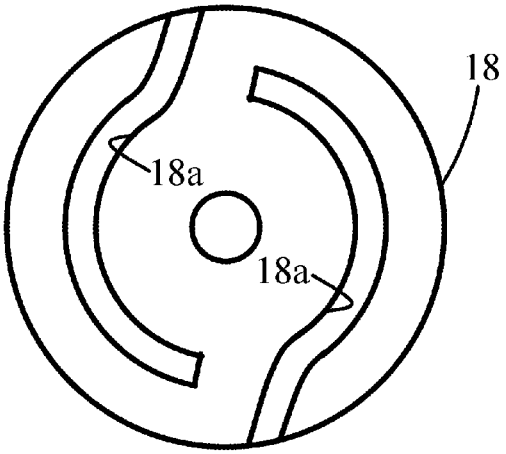
FIGS. 7A and 7B are rear views of a control member.
Figure 7B:
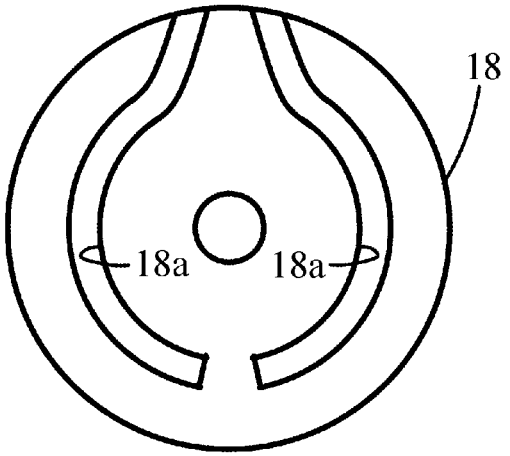

As shown in FIG. 2, an engaging groove 18*a* is formed on a surface of the control member 18 so as to receive the projection 14*c* formed on the surface of the ratchet 14. When the ratchet 14 rotates together with the rope reel 12, the projection 14*c* is guided along the engaging groove 18*a*, thereby causing the front end portion 14*b* of the ratchet 14 to project radial outward. That is, the engaging groove 18*a* extends to guide the pivoting movement of the ratchet 14 to project radial outward when the ratchet 14 rotates together with the rope reel 12. Although it is sufficient to form one engaging groove 18*a* in the control member 18, two engaging grooves 18*a* may be formed. For example, two engaging grooves 18*a* may be formed in the control member 18 in a point symmetry manner, as shown in FIG. 7A. Alternatively, two engaging grooves 18*a* may be formed in the control member 18 in a line symmetry manner, as shown in FIG. 7B. If two engaging grooves 18*a* are formed in the line symmetry manner, the same control member 18 can be used for both of the configuration of FIG. 1 and the configuration of FIG. 6.

As the control member 18 guides the ratchet 14, the front end portion 14*b* of the ratchet 14 is inserted into the engagement portion 15*a* of the drive pulley 15 to thereby engage therewith. Further, the front end portion 14*b* of the ratchet 14 contacts the ratchet receiving unit 12*c* of the rope reel 12 as shown in FIG. 1.

Next, the operation of the recoil starter 10 according the present embodiment will be described.

Before the engine starts, the ratchet 14 is in the retracted position, that is, retracted inwardly of the drive pulley 15.

When the recoil rope 13 is pulled in this state, the rope reel 12 is rotated, and the ratchet 14 is rotated together therewith. On the other hand, the control member 18 is not immediately rotated, since it is attached to the reel supporting unit 11*a* with predetermined rotational resistance. Thus, when the ratchet 14 is further rotated together with the rope reel 12, since the projection 14*c* is guided by the engaging groove 18*a*, the ratchet 14 is pivoted so that the front end portion 14*b* projects radial outward.

As the ratchet 14 is pivoted, the front end portion 14*b* projects radial outward and is inserted into the engagement portion 15*a* of the drive pulley 15. And, the pivoting movement of the ratchet 14 is stopped after the front end portion

14*b* collides with the ratchet receiving unit 12*c* of the rope reel 12 so as to be stably supported by the ratchet receiving unit 12*c*. Then, since the drive pulley 15 rotates together with the rope reel 12 via the ratchet 14, the engine can be started.

When the recoil rope 13 is released after the engine starts, the rope reel 12 is rotated in the reverse direction by the urging force of the recoil spiral spring. As a result, the recoil rope 13 is rewound, and the ratchet 14 returns to the retracted position along the engaging groove 18*a*.

Figure 5:
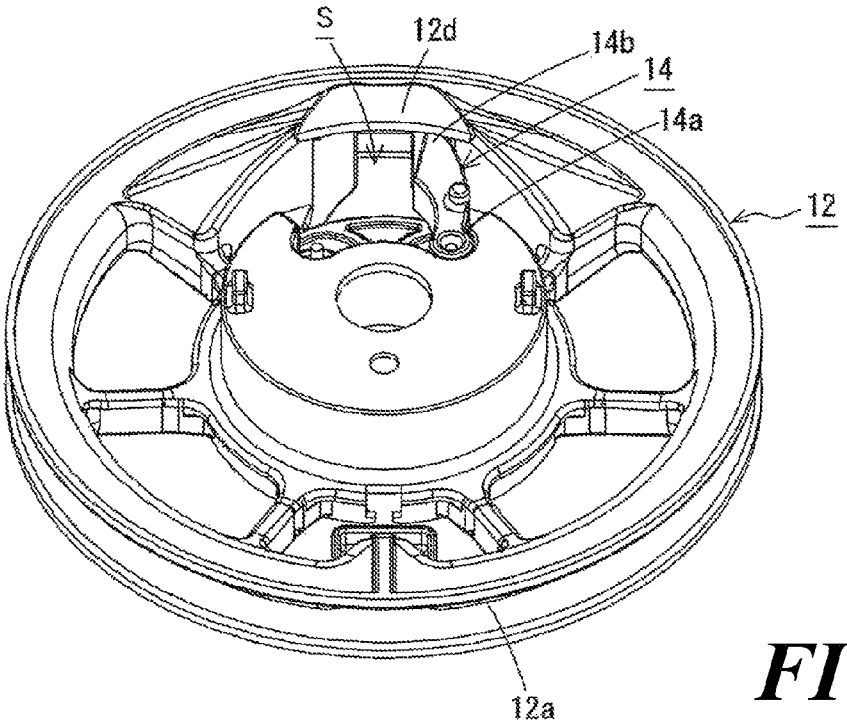
FIG. 5 is a perspective view of the rope reel and a ratchet attached thereto.

In the present embodiment, the reinforcing unit 12*d* bridges between the two facing ratchet receiving units 12*c* as shown in FIG. 5. The reinforcing unit 12*d* extends in the circumferential direction with respect to the ratchet receiving units 12*c* as its leg portions, and is provided to define a space S for allowing the pivoting movement of the ratchet 14. Since the reinforcing unit 12*d* reinforces the ratchet receiving units 12*c* on which a load is intensively imposed, deformation of the ratchet receiving units 12*c* can be effectively prevented.

In the present embodiment, a material for the rope reel 12 is not required to have a high rigidity, thereby reducing the material cost. When molding the rope reel 12, the space S between the two ratchet receiving units 12*c* may be defined by inserting a mold which is movable in the thickness direction of the rope reel 12 between the two ratchet receiving units 12*c*. As a result, the space S between the two ratchet receiving units 12*c* is opened on at least one side of the rope reel 12, thereby weakening the rope reel 12. Such opening could be avoided, but it requires, for example, a mold which is movable in the radial direction of the rope reel 12, thereby complicating the molding system and increasing the manufacturing cost. However, by providing the reinforcing unit 12*d* to bridge between the two facing ratchet receiving units 12*c*, the rope reel 12 can be structurally reinforced. Further, by arranging the reinforcing unit 12*d* on the other side of the rope reel 12, the mold for defining the space S is allowed to be removed in the thickness direction of the rope reel 12 from the opening formed on the one side of the rope reel 12, that is, the provision of the reinforcing unit 12*d* does not necessitate the mold which moves in the radial direction of the rope reel 12. Thus, the sufficient strength can be maintained while suppressing the material cost and the molding cost.

Further, the reinforcing unit 12*d* is formed to cover the front end portion 14*b* of the ratchet 14 projecting outward to contact the ratchet receiving unit 12*c* with a small gap. Thus, floating of the front end portion 14*b* of the ratchet 14 can be suppressed by the reinforcing unit 12*d*.

According to the present embodiment, the rope reel 12 includes the ratchet receiving units 12*c* arranged to receive the front end portion 14*b* of the ratchet 14 being inserted into the engagement portion 15*a* of the drive pulley 15, and the bridge-shaped reinforcing unit 12*d* formed on the ratchet receiving units 12*c* as its leg portions. Thus, the reinforcing unit 12*d* reinforces the ratchet receiving units 12*c* on which a load is imposed, thereby preventing deformation of the rope reel 12. Since the reinforcing unit 12*d* is formed continuously with the ratchet receiving units 12*c*, the rope reel 12 can be structurally simplified and can be reduced in weight.

Since the reinforcing unit 12*d* is formed to cover the front end portion 14*b* of the ratchet 14 projecting outward, floating of the front end portion 14*b* can be suppressed, and the ratchet 14 can be prevented from coming off the ratchet receiving unit 12*c* even when the rope reel 12 is deformed. Since this effect is achieved by the reinforcing unit 12*d*, it is unnecessary to provide another member arranged to suppress the floating, thereby simplifying the structure.

Since the ratchet receiving units 12*c* are provided in a line symmetry manner with respect to the reinforcing unit 12*d*, the recoil starter 10 can be applied to an engine regardless of its rotation direction by using either one of the ratchet receiving units 12*c*. Thus, it is unnecessary to manufacture two kinds of rope reels 12 for both rotation directions of engines, thereby reducing the manufacturing cost.

Although the above-described embodiment exemplifies a specific shape of the shape of the reinforcing unit 12*d*, any shape can be applied as long as the reinforcing unit 12*d* can increase the strength of the rope reel 12 with respect to the ratchet receiving units 12*c* as its leg portions. For example, the reinforcing unit 12*d* may be formed to have a dome shape in which a wall section is provided on the outer circumference side of the ratchet receiving units 12*c* in addition to the above-exemplified shape.

The invention claimed is:

1. A recoil starter including:

a starter case;

a rope reel attached rotatable to the starter case;

a recoil rope wound around the rope reel;

a ratchet pivotably attached to the rope reel; and a drive pulley reconnected to an engine, the drive pulley having an engaged unit engageable with the ratchet, wherein, when the rope reel is rotated by pulling the recoil rope, the ratchet pivots to engage the engaged unit of the drive pulley to thereby transmit a torque of the rope reel to an engine, and wherein the rope reel has:

two ratchet receiving units arranged to receive a front end portion of the ratchet when it is engaged with the engaged unit of the drive pulley;

a reinforcing unit that extends in a circumferential direction of the rope reel to bridge the two ratchet receiving units; and wherein the rope reel comprises two ratchet attachment portions on which the ratchet is pivotably attached, the two ratchet attachment portions selectively receiving the ratchet in a mirrored orientation, respectively, depending on a rotation direction of the engine, wherein the two ratchet receiving unites respectively correspond to the two ratchet attachment portions and wherein the reinforcing unit extends in the circumferential direction of the rope reel with respect to the ratchet receiving unit as leg portions thereof, the reinforcing unit being connected between the two ratchet receiving units.

2. The recoil starter of claim 1, wherein the reinforcing unit is formed to cover the front end portion of the ratchet when it contacts the ratchet receiving unit and to thereby suppress floating of the front end portion of the ratchet.

3. The recoil starter of claim 1, wherein the two ratchet receiving units are provided in a line symmetry manner with respect to the reinforcing unit.

4. The recoil starter of claim 3, further including:

a control member attached to the starter case concentrically with the rope reel wherein the ratchet has a projection , and the control member has an engaging groove which receives the projection and which extends to guide a pivoting movement of the ratchet to project radial outward, and wherein two engaging grooves are provided as the engaging groove in a line symmetry manner.

5. A recoil starter including: a starter case;

a rope reel attached rotatable to the starter case;

a recoil rope wound around the rope reel;

a ratchet pivotably attached to the rope reel;

a drive pulley connected to an engine, the drive pulley having an engaged unit engageable with the ratchet; and a control member attached to the starter case concentrically with the rope reel, wherein, when the rope reel is rotated by pulling the recoil rope, the ratchet pivots to engage the engaged unit of the drive pulley to thereby transmit a torque of the rope reel to an engine, and wherein the rope reel has:

two ratchet support shafts on which the ratchet is pivotable, the two ratchet support shafts selectively receiving the ratchet in a mirrored orientation, respectively, depending on a rotation direction of the engine; and two ratchet receiving units respectively corresponding to the two ratchet support shafts and arranged to receive a front end portion of the ratchet when it is engaged with the engaged unit of the drive pulley, wherein the ratchet has a projection, and wherein the control member has two engaging grooves that selectively receive the projection depending on the orientation of the ratchet and that guide a pivoting movement of the ratchet to project radial outward, the two engaging grooves being provided in one of a line symmetry or a point symmetry manner.

* * * * *